US007879408B1

(12) United States Patent
Rantanen

(10) Patent No.: US 7,879,408 B1
(45) Date of Patent: Feb. 1, 2011

(54) METHOD AND APPARATUS FOR SPREADING TREATING AGENT ON A MOVING WEB

(75) Inventor: Rauno Rantanen, Muurame (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/019,120

(22) PCT Filed: Jun. 29, 2000

(86) PCT No.: PCT/FI00/00599

§ 371 (c)(1),
(2), (4) Date: Jan. 30, 2002

(87) PCT Pub. No.: WO01/02098

PCT Pub. Date: Jan. 11, 2001

(30) Foreign Application Priority Data

Jun. 30, 1999 (FI) ..... 991498

(51) Int. Cl.
*B05D 1/02* (2006.01)
*B05D 7/00* (2006.01)
*B05B 7/06* (2006.01)
*B05B 9/00* (2006.01)

(52) U.S. Cl. ..... 427/427.3; 427/421.1; 118/300; 118/313; 118/314; 118/323

(58) Field of Classification Search ..... 427/421, 427/299, 424, 427.3, 444, 428.01, 428.19, 427/356, 357, 358; 118/300, 302, 314, 324, 118/325, 323, 665, 690; 428/34.1, 411.1, 428/221, 304.4, 313.3, 314.2, 156
See application file for complete search history.

(56) References Cited

U.S. PATENT DOCUMENTS

| | | | | | |
|---|---|---|---|---|---|
| 2,249,274 | A | * | 7/1941 | Faine | 239/556 |
| 3,301,699 | A | * | 1/1967 | Mozzi | 427/9 |
| 4,072,772 | A | * | 2/1978 | Franz | 427/164 |
| 4,105,162 | A | | 8/1978 | Drori | 239/109 |
| 4,618,100 | A | * | 10/1986 | White et al. | 239/440 |
| 4,817,875 | A | | 4/1989 | Karmeli et al. | 239/542 |
| 4,901,093 | A | * | 2/1990 | Ruggiero et al. | 347/70 |
| 5,219,618 | A | * | 6/1993 | Daniels | 427/356 |
| 5,405,087 | A | * | 4/1995 | Waryu et al. | 239/288 |
| 5,614,264 | A | * | 3/1997 | Himes | 427/424 |
| 5,649,867 | A | * | 7/1997 | Briggs | 472/128 |
| 5,736,195 | A | * | 4/1998 | Haaland | 427/180 |

(Continued)

FOREIGN PATENT DOCUMENTS

CA 2141473 8/1995

(Continued)

*Primary Examiner*—David Turocy
(74) *Attorney, Agent, or Firm*—Cohen Pontani Lieberman & Pavane LLP

(57) ABSTRACT

A method and apparatus for spreading a treating agent, for example, size or a coating onto a moving surface in the manufacture of the web-shaped folios or paper and paperboard and various sheet products in particular, includes feeding the treating agent into at least one feeding chamber and directing the agent from the feeding chamber onto the moving surface. Jets are formed from the treating agent by directing the agent through at least one nozzle plate comprising openings that are defined by the nozzle plate around the entire periphery, and the formed jets are applied directly onto the moving surface.

62 Claims, 3 Drawing Sheets

U.S. PATENT DOCUMENTS

| | | | | | |
|---|---|---|---|---|---|
| 5,789,022 | A | * | 8/1998 | Kustermann et al. | 427/211 |
| 5,790,147 | A | * | 8/1998 | Hensel | 347/28 |
| 5,803,410 | A | * | 9/1998 | Hwang | 244/208 |
| 5,964,952 | A | * | 10/1999 | Kunze-Concewitz | 134/2 |
| 6,036,105 | A | * | 3/2000 | Sanada et al. | 239/104 |
| 6,063,449 | A | | 5/2000 | Koskinen et al. | |
| 6,063,450 | A | * | 5/2000 | Bernert et al. | 427/475 |
| 6,106,902 | A | | 8/2000 | Koskinen et al. | |
| 6,130,682 | A | * | 10/2000 | Kohno et al. | 347/19 |

FOREIGN PATENT DOCUMENTS

| | | | |
|---|---|---|---|
| EP | 0 389 738 | A2 | 10/1990 |
| EP | 0 682 571 | B1 | 11/1995 |
| FR | 2 173 546 | A | 10/1973 |
| GB | 1398675 | | 6/1975 |
| JP | 402281959 | A * | 3/1990 |
| JP | 2-281959 | | 11/1990 |
| JP | 7313914 | | 12/1995 |
| JP | 10216598 | | 8/1998 |
| JP | 11165098 | | 6/1999 |
| JP | 11513303 | | 11/1999 |
| WO | WO 99/13158 | A1 | 3/1999 |

* cited by examiner

METHOD AND APPARATUS FOR SPREADING TREATING AGENT ON A MOVING WEB

PRIORITY CLAIM

This is a national stage of PCT application No. PCT/FI00/00599, filed on 29 Jun. 2000. Priority is claimed on that application and on Application No. 991498, filed in Finland on 30 Jun. 1999.

FIELD OF THE INVENTION

The invention relates to a method and apparatus for spreading a treating agent, such as surface size, water or a coating mix, as an unsupported jet, to alter the properties of a web, onto the surface of the web to be treated or onto a surface that transfers the treating agent onto the surface of the web. The invention can also be applied to treating plate-like products instead of roll coaters or curtain coaters, for example.

BACKGROUND OF THE INVENTION

At present, various methods are used to coat and treat paper and paperboard. Coating is often carried out in two phases so that first, the coating is spread onto the web and the final layer of coating is made separately by using a coating knife, a rod or an airbrush. Treating methods are also available, which provide the correct and sufficiently even amount of treating agent without doctoring. Such methods include, for example, spray coating and, in some cases, jet or curtain coating. In short dwell time coating, the layer of coating or size is immediately evened in connection with the application by using the coating knife or rod that defines the application chamber. The manner of spreading and evening the treating agent has an effect on the product's properties and, thus, the selection of the method of treatment can provide end product qualities suitable for various purposes.

Most spreading devices for treating agents that are currently in use are large and complex. All the devices have limitations in operation related to the product's quality, production rate, and other matters, which is why they are usually suitable for producing a limited product range only. Fitting bulky equipment in place of old equipment when renewing machines is difficult, limiting the alternatives used in modernization. One problem with the applicators most frequently used is that the devices use a large overflow and number of applications, so that part of the coating is returned, as return flow, either from the applicator or the doctor to a tank, from where it is again pumped into the applicator. In that case, the treating agent gets in contact with air and forms air bubbles, which must be removed during the circulation of the treating agent before the agent can be fed into the applicator again. Air removal is difficult and deaeration devices are expensive. In return circulation, the treating agent can easily get dirty or otherwise contaminated, and we must ensure that the agent remains clean. Normally, biocides must also be added to the treating agent to prevent the growth of bacteria, which causes various problems. Consequently, there is a need for new methods of treating paper and board webs. In paperboard manufacture in particular, it would be preferable to provide such a method and a device to spread surface size on the surface of the web, which makes it possible to apply a sufficient amount of size on the web's surface at a considerably higher velocity than before, but which would be cost-effective enough also when used in board machines with low production volumes. Adjusting the amount and the profile of size in production is also an especially big problem.

SUMMARY OF THE INVENTION

The purpose of the invention is to provide a new kind of method and device, which can solve the known prior art problems described above.

In accordance with the invention, treating agent is spread on the web or on a moving surface that transfers the treating agent onto the web, from several parallel openings, which are formed in a plate-like piece so that the plate surrounds the openings around the entire outer periphery of the opening, whereupon the jet is defined by the opening made in the plate-like piece.

In this context, the plate-like piece also refers to non-planar pieces, such as the wall of a tube, for example, which has openings according to the invention.

The invention provides considerable advantages.

With the aid of the invention, a very simple and reliable device is provided for directly or indirectly spreading the treating agent on the surface of a moving board or paper web. The device can be used for treating other material as well, for example, for sizing plastic self-adhesive material or treating reinforced fibre matting. In principle, the device only comprises a simple nozzle bearer and members to support it in the vicinity of the web. The device can be rendered very narrow, so that it even fits the gap between the roll and the moving web. Thus, the device can be used in many places where it has been difficult or impossible to apply the treating agent, and the device can even be located in production lines, where no treating with a fluid treating agent has been carried out earlier. In that case, unless there is enough drying rower available, we are mainly talking about water wetting or the application of a small amount of surface size. One embodiment of the invention comprises the feeding of an even moisture film, when the roll, the belt or the like of a paper machine is washed and an accurate amount of water is needed in the form of a film.

The invention can also be applied in further processing of webs in the manufacture of the adhesive surfaces of self-adhesive materials, for example. The method works well within a large velocity range, so that it can be applied in renewing equipment, when production rates are low, and in new machines, whereupon the production rate can be considerable. The adjustment range of the feed rate of the device's treating agent is large and it enables the application of high coat weights even on the first application round. However, the device can be used for treating a two or multi-phase coating base either as a so-called wet-on-wet treatment, where a second layer of treating agent is spread on top of the previous layer before the previous layer has dried or has been dried. Of course, the layers can be either dried entirely or partly, as traditional drying does. The same device can be used to spread various treating agents. The device is suitable for treating water, mixed adhesives, and coating slips with only minor structural changes. As the treating agent is fed through openings made on a thin nozzle plate and defined by the plate, the jets of treating agent become uniform so that not much air is mixed with the treating agent and the mass and impulse intensity of the jet are high, so that the agent transfers and attaches to the moving surface well, even through the air layer carried by the surface. However, at high speeds of the treated base in particular, it is preferable to use, before the coater, a member that eliminates the adverse effect of the air, which travels with the base, on the transfer of the treating agent onto the moving surface. This member can be, for example, a plate-like piece near the moving surface, or a plate-like piece or suction member that touches it. If it is a member that touches the moving surface, it is preferable to lubricate or wash with steam, steam and air or water jet spraying.

The device does not require a lot of equipment; in other words, the running tank, the edge scrapers and, in some cases, even the deaerator can be omitted. For example, in surface sizing, the surface size starch can preferably be conveyed to the device directly from the jet boiler used for manufacturing the solution. The device can be used without scraping, whereupon no stream of treating agent is in contact with air, and air cannot be mixed with the treating agent. The device can either be used completely without return circulation, so that all matter fed into the plenum chamber of the applicator is spread on the web, or if a flow-through is arranged in the plenum chamber to rinse the chamber, it is airtight and has no oxygen. The growth of bacteria especially problematic for sizes is prevented in this case, too, and no biocides need to be mixed with the treating agent. The wastewater, for example, that results from cleaning and washing the device does not hamper the operation of the plant's water purification system now. As no running tank is needed, the change in mode for a different treating agent mixture is quick to carry out. Treating agents with a low viscosity spread easier on the surface to be treated. In case of high-viscosity substances and otherwise, a coating rod or knife can be used, if needed, to even any scratches, but also in that case it is preferable to keep the dosed amount near the final desired amount of treating agent.

The device works well also at high temperatures of treating agent, so that by adjusting the temperature of the treating agent, one can influence its viscosity and other properties. As already stated above, the invention can be applied to various substances, in other words, it can be adapted to substances that flow in various ways, and even high-viscosity substances containing a lot of solid matter can be treated with the method according to the invention, as the parts of flow paths with small diameters are very short and thus do not prevent the flow of high-viscosity mixtures. This is why the device does not block up easily and it is easy to either clean by hand or various automatic cleaning devices. In principle, the only wearing part of the arrangement is the plate containing the openings that define the jet of the treating agent, but as the amount of the substance applied also depends on the feed pressure of the substance, it is easy to compensate for the possible wear of the openings by changing the feeding pressure. Indeed, only the coating mixes containing solid matter cause wear, and when feeding size or water, the wear is practically nonexistent at the low pressures used, and very insignificant with coating mixes containing solid matter.

The invention is well suited to the manufacture of multilayer paperboard and it facilitates the feed of size, which bonds the layers, between the layers. The invention can also be used to apply a coating or size on a web, when it is in a semi-wet state, in other words, before the final drying. In that case, feeding can be carried out by the drying part, the pressing part or the web part of the machine, for example, directly to the nip, belt or roll or directly to the surface of the web.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention is examined in detail with the aid of examples and with reference to the appended drawings.

DETAILED DESCRIPTION OF THE PRESENTLY PREFERRED EMBODIMENTS

Figure 1:
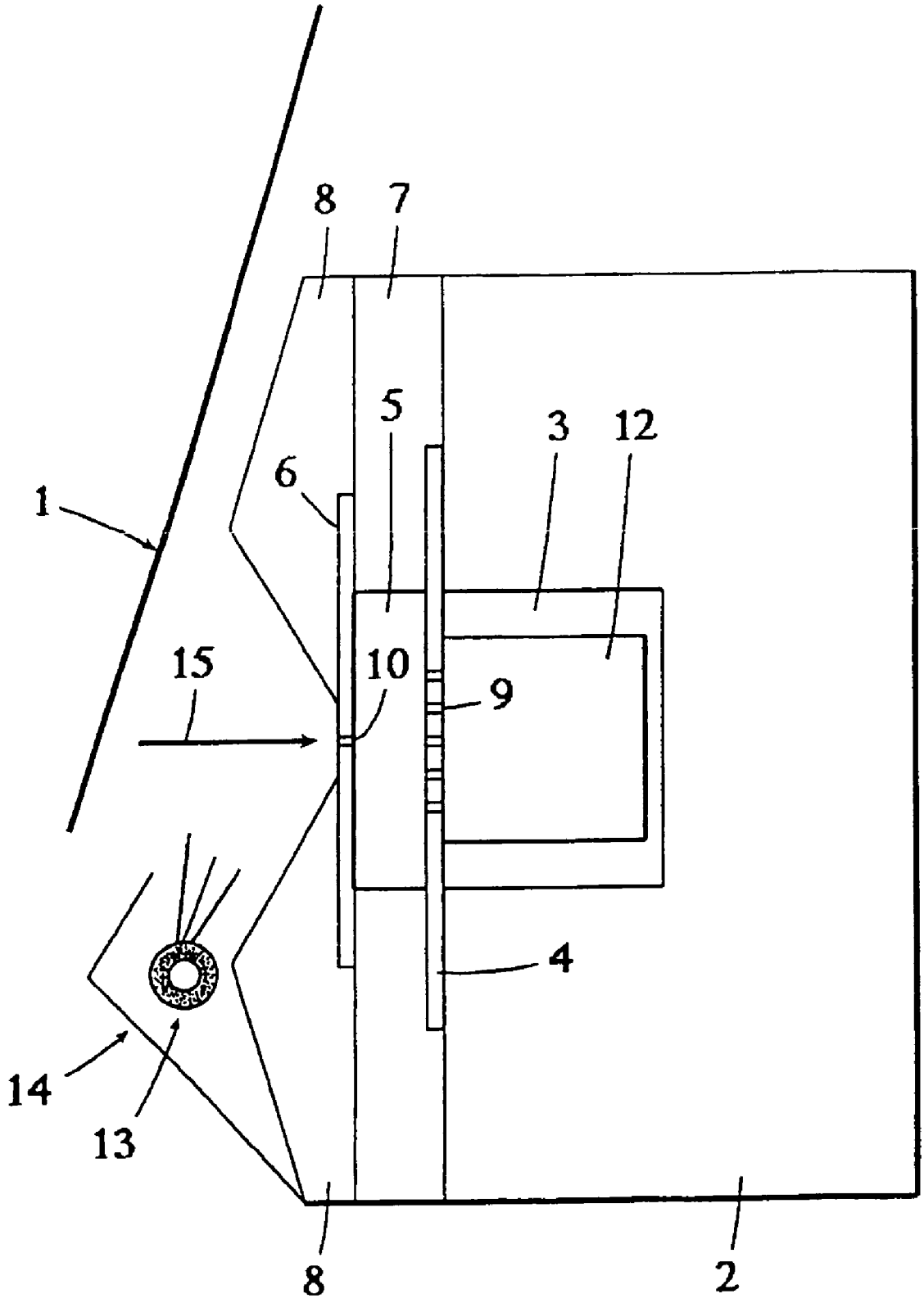
FIG. 1 is a side view of a cross-section of one arrangement according to the invention.

In FIG. 1, an application device for applying a treating agent to a surface of a web is fitted in the vicinity of a film transfer roll 1. The application device is best installed for applying a treating agent to a surface of a web on the side or on top of the moving web, or as the application device of a film transfer coater, as is the case in this example. If the application device is used to spread the treating agent directly on the web, the web can be supported at the opposite side with respect to the application side by a roll, a belt, a wire or another support member. In a simultaneous, two-sided treatment, the jets hitting the web at opposite sides actually also support the web. The device consists of a body container 2, in which a feeding chamber 3 is formed. The feeding chamber 3 is closed by a screen plate 4, which is clamped to the body 2 by a spacer 7. The spacer 7 has an opening next to the feeding chamber 3, the opening being closed by a nozzle plate 6 attached on top of the spacer 7 by using attachments 8. Thus an intermediate case 5 is formed between the nozzle plate 6 and the screen plate 4. The body container 2, the spacer 7, and the attachments 8 can be bonded by using pressure hoses and springs, for example, so that when pressure is released from the pressure hoses, the springs part these members and the screen plate and the nozzle plate can be replaced.

The device operates so that treating agent is fed to the feeding chamber 3, consisting of water, size, a coatings mix or an other fluid used for treating the web to be manufactured, in accordance with the application. The screen plate 4 has openings 9, the diameter of which is preferably smaller than the nozzle openings 10 of the nozzle plate. The treating agent fed into the feeding chamber 3 travels through the screen plate 4 and any solid impurities in the treating agent remain in the feeding chamber, from where they can be removed by recycling the excess treating agent in the feeding chamber or in connection with the washing of the device. One preferred way to clean the screen plate during a run is to reel it, to and fro, in the washing chambers at the end of the device, and to wash the screen plate, for example, with the treating agent recycled in the cleaning chamber, which agent is screened in this washing cycle. All substances used do not necessarily need the screen plate 4. If the device is used to wet the web, the screen can be omitted, when feeding water or steam, but when spreading coating mixes, solutions, emulsions or the like containing solid matter, the screen is often necessary, because even if the lumps formed in the coating do not necessarily block the nozzle plate, they can cause defects in the coating layer.

From the intermediate case 5, the treating agent goes through the nozzle openings 10. In the openings 10, jets are formed from the treating agent, directed towards the opposite surface, in this case, the film transfer roll 1. The diameter of the jets is very small, but the jets are not dispersed into spray, whereupon their mass and impulse strength are high compared with a spray, and the treating agent attaches well to the surface it hits, and the jet is even able to permeate the air layer carried by the moving web. The thickness of the nozzle plate 6 made of steel can be about 0.1-0.5 mm, and the width of the unsupported area between attachments 8 can be 0.5-2 mm. If the pressure of the intermediate case against the nozzle plate is 0.1 bar, the forces exerted on the nozzle plate and the seals of the device are minor, whereupon the nozzle plate can be thin and sealing is easy. If the diameter of the nozzle openings is 0.1-0.7 mm, the proportion of the diameter of the formed openings 10 to the thickness of the plate, i.e., to the length of the opening is great, but normally less than 1. As the opening is very short, no blocking can be formed by material that gradually adheres to the opening, but particles smaller than the opening pass through easily. Thus, blocking material does not easily stay in the opening. The device works at high feed pressures of the substance to be treated but, in that case, the size of the opening must be decreased whenever the pressure increases, and it may happen that we have to use a very small and unpractical size of opening. Correspondingly, the velocity of the spray increases, so that the pressure can be increased, if a high impact velocity is needed. The surfaces of the nozzle plate are easy to clean with a flow or by scraping, so that the substance accumulating on top of the openings on the nozzle plate cannot block the openings. However, the main principle is that the screen plate before the nozzle plate is very fine compared with the size of the opening of the nozzle plate, so that no blocking substances can get to the nozzle plate. The nozzle plate can also be rendered to traverse in the cross direction, so that it can be washed continuously or in stages. In that case, it is preferable that a low-pressure chamber is arranged on both sides of the nozzle plate, by which any coating material that possibly leaks from the seals is sucked out of the device. Liquid can also be directed to the washer suction duct to eliminate the possible risk of blocking caused by precipitates, for example.

If the treating agent has a high surface energy and individual jets neck in with one another, it is preferable to use a single-row nozzle plate, where the necks between the openings are as small as possible, so that an integral, curtain-type coating spray is achieved. In this application, it might be preferable to increase the surface energy or film formation of the treating agent by adding a suitable additive to the treating agent mixture. However, it is usually better to keep individual jets separate so that they do not form an integral, film-like coating until they meet the coating base. In that case, it is preferable to use a multi-row nozzle plate, so that the openings can be far from one another and yet a good coverage is achieved in the direction of the profile, so that the distance of the openings in the profile direction is as desired. There can be two, three or more rows of openings. The outer surface of the nozzle plate can be treated with a coating agent that repels the treating agent to prevent necking. The coating agent can be used to prevent individual jets from necking into bundles and touching one another on the surface of the nozzle plate, or to decrease this effect. In most cases, the treating agent can be polytetrafluoroethylene (Teflon®). The treatment with the coating agent also prevents the treating agent from sticking to the outer surface of the nozzle plate and causing the treating agent to run along the nozzle surface, as well as the ensuing dripping of the treating agent, in an uncontrolled manner, onto the surface to be treated. The nozzle plate can also be designed so that it is bowed out or that the row of openings is defined by sharp, batten-type projections. In this embodiment, the surface energy of individual jets can be decreased with chemicals. On the basis of the above, the type of the jet can be modified in accordance with the requirements of the application by changing the hole distances, for example.

It is preferable to connect, to the device, adjusting devices to adjust the angle and the distance of the jet. At the moment, the most advantageous way of spraying is to carry it out slightly downstream with respect to the direction of motion of the surface to be treated, and the spraying distance is a few or a few dozens of millimeters. It its preferable to spread the size on the surface of the web at an adjustable distance from the roll nip, whereupon its penetration into the web can be adjusted or, in film transfer sizing in particular, the size on the one side of the web can be measured directly onto the surface of the web before the roll nip, and the size on the other side can be measured onto the surface of the second roll of the size press.

To achieve the greatest additional strength, when paperboard is treated with size, it is important to measure as much size on the web as it can receive. In that case, when the amount of dosage grows too high, there is a risk that the size makes a pool in the roll nip of the web and the film transfer roll, whereupon size splashes from the pool into the environment. The formation of the pool is preceded by the formation of a so-called mini pool; therefore, the way of running can be automated by photographing the roll nip with a video camera and processing the image by a graphics-processing programme. In that case, the camera follows the formation of the pool, and when the pool grows too large, the amount of dosage is decreased by adjusting the flow of size on the basis of an image analysis. If the pool becomes too large, the size splashes from the pool and contaminates the machine. A minor formation of a mini pool does not cause adverse splashing, so its formation can be considered an indication of the largest possible amount of dosage.

When the machine has been stopped and the equipment is restarted, it is preferable to start the activation with water, after which the feeding of the actual treating agent is started. During the start, water or the treating agent can be fed into a trough, which is placed in front of the spray and removed, when the treating conditions suitable for production have been reached.

In some cases, it is necessary to clean the nozzle plate 6 or the screen plate 4 during operation. FIG. 1 shows three possible cleaning methods. To clean the screen plate 4, a steel plate 12 has been placed in the feeding chamber 4 in the direction of the chamber, one edge of the plate being against the surface of the screen plate 14 on the side of the feeding chamber 3. The steel plate 12 can be moved in the direction of the chamber, so that it scrapes off any impurities attached to the surface of the screen plate 4 on the side of the chamber 3. Matter that is handled may dry on the surface on the side of the surface that is treated of the nozzle plate 6. This can be prevented with the aid of steam spraying by blasting steam against the nozzle plate 6 from the steam nozzles located next to the nozzle plate. The steam nozzles can be formed by simply making suitable size holes directly in a steam tube 13 or by using one or more traversing nozzles. A collector trough 14 is fitted around the steam tube 13, collecting the condensed steam and the material diluted by steam. If such steam purification is used, the device should be located so that the collector through 13 is at the lower edge of the device. A minor leak of the treating agent directly to the surface that is treated is often acceptable, whereupon no collector trough is needed. When needed, the openings 10 in the nozzle plate can be cleaned by a needle-shaped water jet 15, which travels in the direction of the row of openings and alternately sprays the openings clean. As the openings do not block easily, such cleaning is seldom needed. During breaks in production, the device can be washed with pressurized water.

Figure 2:
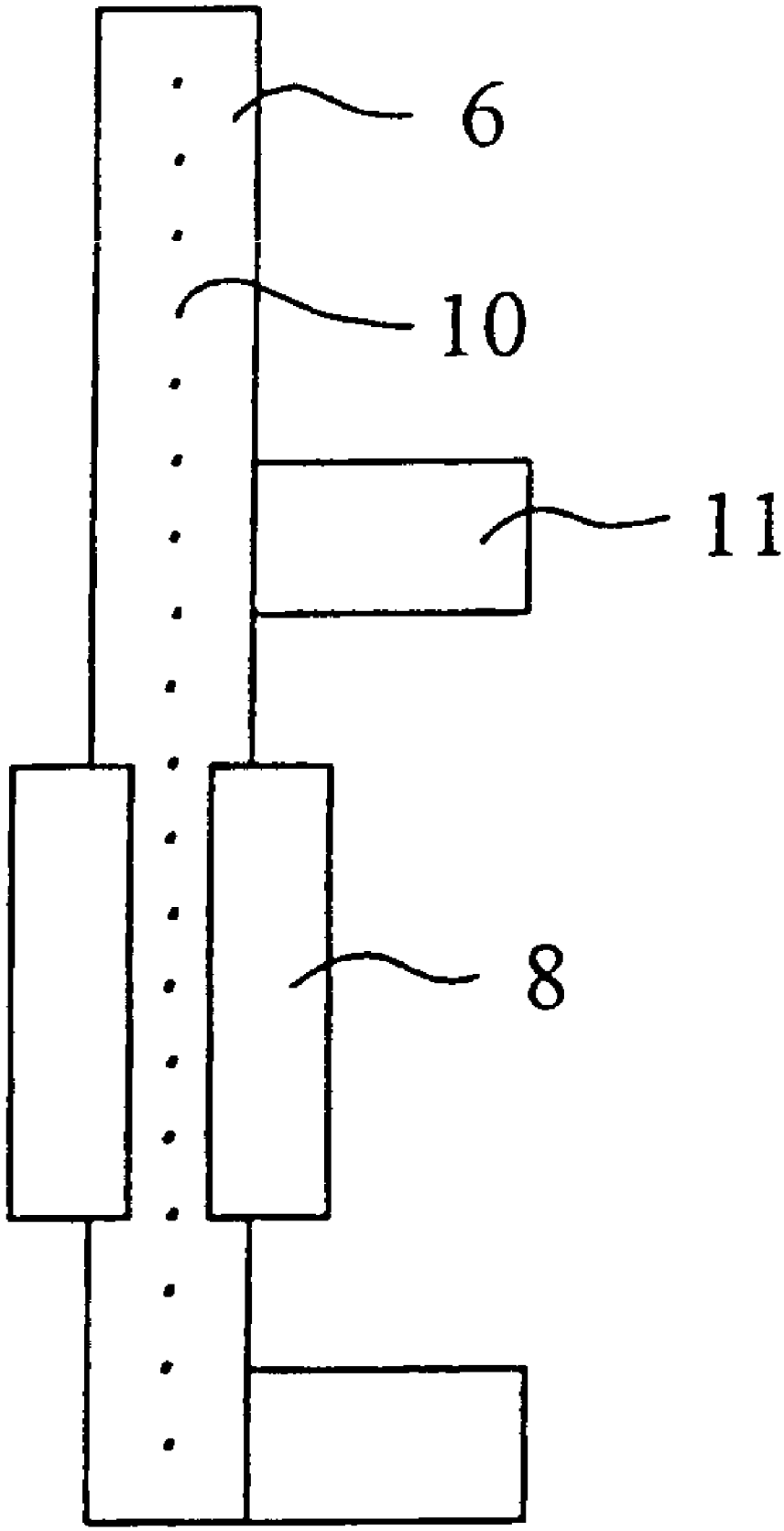
FIG. 2 is a top view of another embodiment according to the invention.

FIG. 2 is a top view of a device, in which the nozzle plate 6 can alternately be taken to the side of the application device for cleaning. In this device, the nozzle plate 6 that is longer than the width of the web to be treated is movingly located between the attachments 8 with the aid of sealed guide bars, for example. The length of the nozzle plate 6 is at least two times greater than the width of the web that is treated. Actuators 11 are placed on both sides of the machine used for treating or manufacturing the web, the actuators being used to move the nozzle plate 6 in the longitudinal direction. As the forces exerted by the pressure in the intermediate case on the nozzle plate are minor, the friction of the seals is low and the power of the actuator can also be low, whereupon the device can be small in size and its manufacture cost-effective. One simple structure for sealing the screen plate is that a groove is formed on the wall of the pressure chamber, along which the screen plate is traversed. As the tolerance of the gap with respect to the screen plate is small, impurities cannot go through the gap to the actual nozzle plate. When the nozzle plate is to be cleaned, it is driven to the side of either one of the actuators 11 with respect to the production line, and is either cleaned automatically by the devices described above or by hand. Alternatively, the nozzle plate can be a continuous loop, whereupon it can be rotated continuously or in stages during the operation of the application device.

Figure 3:
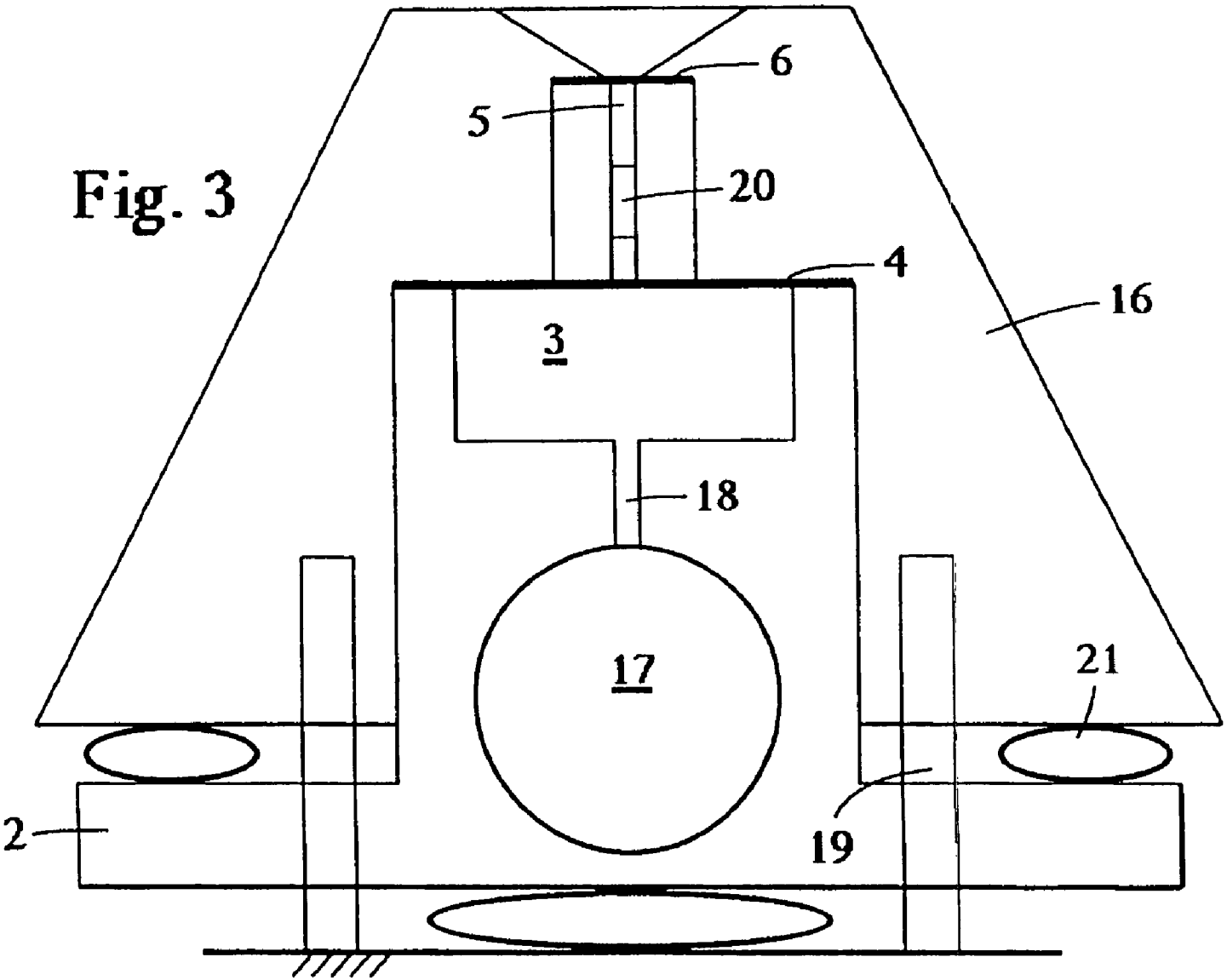
FIG. 3 is a side view of a cross-section of yet another embodiment of the invention.

FIG. 3 shows an embodiment, in which the treating agent is fed to the nozzle plate by using two-stage choking. The body container 2 of the device comprises a feed channel 17, from where borings 18 go to a feeding chamber 3, which is closed by a screen plate 4. Furthermore, second borings 20 come from the screen plate 4 to an intermediate case 5 that is behind the nozzle plate 6. In this solution, the body container 2 is closed by an integral attachment 16, which is connected to the body container 2 by using bolts 19 and pressure tubes 21. As the feeding pressure of the treating agent must be kept higher with respect to the pressure difference required by the nozzle openings to ensure a good cross profile, such a choking system is often necessary. In the device in FIG. 3, choking is three-stage, i.e., the first pressure drop takes place in the first borings, the second one across the screen plate, and the third one in the second borings. Simply measuring the volume flow coming to the device, or the difference between the incoming and the outgoing flow can carry out the control of the coat weight, whereupon the amount of coating going to the web is obtained directly from the measuring. With the flow control, the amount of treating agent can automatically be adjusted to the desired value, taking into consideration the velocity of the machine.

The nozzle plate can be manufactured from various materials, although stainless spring steel strip is very advantageous because of its cost-effective price and easy processing and manufacture. The strip can be coated with the coatings that are generally used in tool manufacture. Other manufacturing materials include ceramics, other metals and alloys of metals, and synthetic materials with or without a coating. It is preferable to make the openings by working them with a laser, plasma spray, electron beam or water jet, because these methods advantageously provide small openings without flashes. Other manufacturing methods, such as drilling, can be used, if the size of the opening required is large enough.

The adjustment range of the amount of the treating agent to be applied by the device implemented according to the invention is very good. The following test results were made on a surface size mixture by a device, to which a nozzle plate had been attached behind the spray nozzle screens of a spray application device.

| 12% size Velocity 1000 m/min | Pressure (bar) | Opening/neck (mm) | Wet film (g/m$^2$) |
|---|---|---|---|
| | 1.2 | 0.5/0.5 | 13 |
| | 1.2 | 0.4/0.4 | 10 |
| | 1.5 | 0.5/0.5 | 36 |
| | 1.5 | 0.4/0.4 | 30 |
| | 1.5 | 0.3/0.3 | 20 |
| | 2.0 | 0.5/0.5 | 110 |
| | 2.0 | 0.5/0.4 | 85 |
| | 2.0 | 0.3/0.3 | 54 |

On the basis of the results, the amount of wet film, 10-40 g/m$^2$, required by several applications, is easy to generate using the method according to the invention.

As the greatest pressure difference in the test arrangements was generated in the nozzle screens, and only a very low pressure acted across the nozzle plate, the feed pressure shown in the table does not correspond to the pressure acting across the openings in the nozzle plate. In spite of the minor pressure difference, the jets provided a good covering.

When experimenting with a laser, making openings in spring steel blanks succeeded well on both 0.3 and 0.5 mm sheet metal.

Solutions deviating from the embodiments described above could also be considered to be included within the scope of the invention.

A fixed or movable nozzle plate can be cleaned continuously or in stages with the aid of ultrasound. Several nozzle plates can be sequentially located, and several sequential or overlapping rows of openings can be located in the same plate. It is easiest to make a circular opening, but the shape of the opening is also easy to modify by using the manufacturing methods described above. The invention can be used to feed a treating agent, such as size, coating, water or steam, directly onto the web, between the layers of the web, onto the film transfer roll or the belt, among other things, or onto a paper or paperboard web manufactured by a separate machine, or onto another continuous sheeting for the further processing of the product. Instead of a planar plate, the openings can be made in a tube or a curved or otherwise bent plate. The openings can either be parallel to the normal of the screen plate's surface or they can be directed obliquely to the normal of the surface to focus the jets in the desired manner.

If an air blocking plate or a doctor is used in front of the jets, it can be moved like the screen plate and the nozzle plate over the ends of the roll or the width of the web, whereupon it can be cleaned by automatic cleaning devices or by hand, when needed. In that case, it is preferable that the blocking plate be a flexible plate or strip, so that it can be rolled or bent. Otherwise, there must be space on the side of the machine, to the extent of at least half the web width, so that the scraping member can be taken to the side far enough. In that case, cleaning is effected alternately on both sides. If cleaning is carried out on one side only, then, of course, the space required must extend to the full width of the web.

In the solution according to the invention, the amount of the treating agent coming to the web can be controlled by changing the size and/or the hole distribution of the nozzle plate openings, the size and/or the hole distribution of the screen plate openings or, in some cases, by changing the size and/or the hole distribution of the openings of the chokings. As these members are easy and quick to change and they have an advantageous price, it is easy to change the size of the openings of the screen or nozzle plates. The size of the nozzle plate openings, for example, can easily be changed to correct the measuring profile. In this way, systematic errors or irregularities in the bottom web, among others, can be corrected. These include, for example, transverse changes in the bite and the porosity of the bottom web, which affect the absorption of the treating agent and other factors that have an impact on the manufacture and the final properties of the product.

In the solution according to the invention, the adjustment of the side limit and the application width is easy; the limit becomes accurate, and no side bleeding occurs. The side limit and the application width can be adjusted by simply blocking the nozzle openings on the side the treating agent is fed by using a moving seal or a similar member. In that case, as the regulating member that blocks the openings can be located in a sealed chamber space, no leakage problems occur. The treating width can also be adjusted automatically by measuring the width of the web or the plate that is treated and by directing the sealing member to the desired distance from the edge or accurately next to the edge. If the treating agent is fed to the feeding chamber from several feeding pipes fitted along the length of the machine in the transverse direction, it is preferable to adjust the feed rate of at least the outermost pipes either on the basis of the flow rate or the web's profile measurements. When required, this control method can be used to the extent of the entire treating width and its efficiency can be enhanced by dividing the feeding chamber by partitions into subchambers in the transverse direction of the web. On the other hand, when the treating width is changed, it is preferable to change the feed rate of the outermost feeding pipes.

In addition to the objects mentioned above, the invention can advantageously be used in connection with the inventions described in Finnish patent applications 990557 and 990008 for the application of both the coating or another treating agent, whereupon the coat weight is in fact adjusted by a separate doctor.

Thus, while there have been shown and described and pointed out fundamental novel features of the present invention as applied to a preferred embodiment thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for applying a treating agent onto a moving surface, comprising the steps of:

(a) feeding a treating agent for treating a web into at least one feeding chamber;

(b) forming continuous jets of the treating agent by directing the treating agent through openings in at least one nozzle plate, the openings in which the jets are formed being defined solely by the at least one nozzle plate; and (c) directing the jets of the treating agent toward the moving surface such that each of the jets are separated from the other ones of the jets when the jets exit the at least one nozzle plate.

2. The method of claim 1, wherein the moving surface is a surface of a web to be treated and said step (c) of directing the jets toward the moving surface comprises directing the jets onto the surface of the web to be treated.

3. The method of claim 2, further comprising the step of moving the at least one nozzle plate transversely relative to the direction of movement of the moving surface, so that at least a portion of the length of the at least one nozzle plate is moved outside of a width of an area of the moving surface to be treated.

4. The method of claim 2, further comprising the step of cleaning the at least one nozzle plate by blasting steam against the at least one nozzle plate.

5. The method of claim 2, further comprising the step of cleaning the openings in the at least one nozzle plate by directing a needle-shaped water jet at the openings.

6. The method of claim 2, further comprising the step of cleaning the at least one nozzle plate with ultrasound at the at least one nozzle plate.

7. The method of claim 2, further comprising the step of controlling the amount of treating agent fed to the moving surface as a function of the volume flow of the treating agent.

8. The method of claim 1, wherein said moving surface is a surface used to transfer the treating agent to a surface of a web to be treated such that said step (c) of directing the jets toward the moving surface comprises directing the jets to the surface used to transfer the treating agent.

9. The method of claim 8, further comprising the step of moving the at least one nozzle plate transversely relative to the direction of movement of the moving surface, so that at least a portion of the length of the at least one nozzle plate is moved outside of a width of an area of the moving surface to be treated.

10. The method of claim 8, further comprising the step of cleaning the at least one nozzle plate by blasting steam against the at least one nozzle plate.

11. The method of claim 8, further comprising the step of cleaning the openings in the at least one nozzle plate by directing a needle-shaped water jet at the openings.

12. The method of claim 8, further comprising the step of cleaning the at least one nozzle plate with ultrasound at the at least one nozzle plate.

13. The method of claim 8, further comprising the step of controlling the amount of treating agent fed to the moving surface as a function of the volume flow of the treating agent.

14. The method of claim 1, wherein said step (c) of directing the jets toward the moving surface comprises directing the jets toward a roll nip between a surface of the web to be treated and a surface that contacts the web in the roll nip such that a portion of the treating agent is applied directly onto the surface of the web to be treated and another portion of the treating agent is applied directly onto the surface that contacts the web in the roll nip.

15. The method of claim 14, further comprising the step of moving the at least one nozzle plate transversely relative to the direction of movement of the moving surface, so that at least a portion of the length of the at least one nozzle plate is moved outside of a width of an area of the moving surface to be treated.

16. The method of claim 14, further comprising the step of cleaning the at least one nozzle plate by blasting steam against the at least one nozzle plate.

17. The method of claim 14, further comprising the step of cleaning the openings in the at least one nozzle plate by directing a needle-shaped water jet at the openings.

18. The method of claim 14, further comprising the step of cleaning the at least one nozzle plate with ultrasound at the at least one nozzle plate.

19. The method of claim 14, further comprising the step of controlling the amount of treating agent fed to the moving surface as a function of the volume flow of the treating agent.

20. The method of claim 1, further comprising the step of feeding the treating agent through a screen plate before said step of directing the treating agent through openings in at least one nozzle plate.

21. The method of claim 20, further comprising the step of moving the at least one nozzle plate transversely relative to the direction of movement of the moving surface, so that at least a portion of the length of the at least one nozzle plate is moved outside of a width of an area of the moving surface to be treated.

22. The method of claim 20, further comprising the step of cleaning the at least one nozzle plate by blasting steam against the at least one nozzle plate.

23. The method of claim 20, further comprising the step of cleaning the openings in the at least one nozzle plate by directing a needle-shaped water jet at the openings.

24. The method of claim 20, further comprising the step of cleaning the at least one nozzle plate with ultrasound at the at least one nozzle plate.

25. The method of claim 20, further comprising the step of controlling the amount of treating agent fed to the moving surface as a function of the volume flow of the treating agent.

26. The method of claim 20, wherein the screen plate comprises a plurality of screen holes, wherein a diameter of the screen holes is smaller than a diameter of the openings in said at least one nozzle plate.

27. The method of claim 26, wherein said step (a) comprises feeding a treating agent from a feed channel through a first boring to the feed chamber and said the treating agent is fed through a second boring after said treating agent is fed through said feed plate and before said step of directing the treating agent through openings in the at least one nozzle plate, wherein pressure drops in the treating agent occur at the first boring, the screen plate, and the second boring.

28. The method of claim 1, further comprising the step of moving the at least one nozzle plate transversely relative to the direction of movement of the moving surface, so that at least a portion of the length of the at least one nozzle plate is moved outside of a width of an area of the moving surface to be treated.

29. The method of claim 28, further comprising the step of cleaning the at least one nozzle plate by blasting steam against the at least one nozzle plate.

30. The method of claim 28, further comprising the step of cleaning the openings in the at least one nozzle plate by directing a needle-shaped water jet at the openings.

31. The method of claim 28, further comprising the step of cleaning the at least one nozzle plate with ultrasound at the at least one nozzle plate.

32. The method of claim 28, further comprising the step of controlling the amount of treating agent fed to the moving surface as a function of the volume flow of the treating agent.

33. The method of claim 1, further comprising the step of cleaning the at least one nozzle plate by blasting steam against the at least one nozzle plate.

34. The method of claim 33, further comprising the step of controlling the amount of treating agent fed to the moving surface as a function of the volume flow of the treating agent.

35. The method of claim 1, further comprising the step of cleaning the openings in the at least one nozzle plate by directing a needle-shaped water jet at the openings.

36. The method of claim 35, further comprising the step of controlling the amount of treating agent fed to the moving surface as a function of the volume flow of the treating agent.

37. The method of claim 1, further comprising the step of cleaning the at least one nozzle plate with ultrasound at the at least one nozzle plate.

38. The method of claim 37, further comprising the step of controlling the amount of treating agent fed to the moving surface as a function of the volume flow of the treating agent.

39. The method of claim 1, further comprising the step of controlling the amount of treating agent fed to the moving surface as a function of the volume flow of the treating agent.

40. The method of claim 1, wherein a thickness of the nozzle plate is in the range of about 0.1-0.5 mm.

41. An apparatus for spreading a treating agent onto a moving surface, comprising:

a body defining at least one feeding chamber for receiving a treating agent; and means for directing the treating agent from the feeding chamber onto the moving surface, said means including at least one nozzle plate that at least partly closes said at least one feeding chamber, said at least one nozzle plate including openings in which continuous jets of the treating agent are formed when the feeding chamber is at least partially filled with pressurised treating agent, wherein each of said openings comprise a periphery defined entirely by said at least one nozzle plate, and wherein said openings in which the jets are formed are defined solely by said at least one nozzle plate, and wherein the jets are directed onto the moving surface, each of the jets being separated from the other ones of the jets at the exit of the jets from the at least one nozzle plate.

42. The apparatus of claim 41, further comprising a screen plate fitted in said at least one feeding chamber such that the treating agent is screened by said screen plate before being directed through the openings in said at least one nozzle plate.

43. The apparatus of claim 42, wherein said at least one nozzle plate has a length that is greater than a width of an area of the moving surface that is to be treated, and further comprising actuators operatively connected to said at least one nozzle plate for moving said at least one nozzle plate at least partly outside the width of the area of the moving surface that is to be treated.

44. The apparatus according to claim 42, further comprising at least one steam nozzle operatively arranged for blowing steam towards said at least one nozzle plate.

45. The apparatus of claim 42, further comprising means for directing at least one needle-shaped water jet at the openings of said at least one nozzle plate.

46. The apparatus of claim 42, further comprising a cleaning plate having an edge and movably fitted in said at least one feeding chamber so that said edge of said cleaning plate scrapes one of said screen plate and said nozzle plate during movement thereof.

47. The apparatus of claim 42, wherein said screen plate comprises a plurality of screen holes, wherein a diameter of said screen holes is smaller than a diameter of said openings of said at least one nozzle plate.

48. The apparatus of claim 47, wherein said body further defines a feed channel and a first boring, said treating agent being fed from said feed channel to said feed chamber through said first boring, wherein a second boring is arranged between said screen plate and said nozzle plate, wherein pressure drops in said treating agent occur at said first boring, said screen plate, and said second boring.

49. The apparatus of claim 41, wherein said at least one nozzle plate has a length that is greater than a width of an area of the moving surface that is to be treated, and further comprising actuators operatively connected to said at least one nozzle plate for moving said at least one nozzle plate at least partly outside the width of the area of the moving surface that is to be treated.

50. The apparatus according to claim 49, further comprising at least one steam nozzle operatively arranged for blowing steam towards said at least one nozzle plate.

51. The apparatus of claim 49, further comprising means for directing at least one needle-shaped water jet at the openings of said at least one nozzle plate.

52. The apparatus according to claim 41, further comprising at least one steam nozzle operatively arranged for blowing steam towards said at least one nozzle plate.

53. The apparatus of claim 41, further comprising means for directing at least one needle-shaped water jet at the openings of said at least one nozzle plate.

54. The apparatus of claim 41, wherein a thickness of said nozzle plate is in the range of about 0.1-0.5 mm.

55. A method for applying a treating agent onto a moving surface, comprising the steps of:

(a) feeding a treating agent into at least one feeding chamber;

(b) forming continuous jets of the treating agent by directing the treating agent through openings in at least one nozzle plate, the entire peripheries of said openings being defined by said at least one nozzle plate;

(c) directing the jets of the treating agent toward the moving surface; and (d) moving the at least one nozzle plate relative to the at least one feeding chamber in a direction transverse to the direction of movement of the moving surface, so that at least a portion of the length of the at least one nozzle plate is moved outside of a width of an area of the moving surface to be treated.

56. The method of claim 55, further comprising the step of cleaning the at least one nozzle plate by blasting steam against the at least one nozzle plate.

57. The method of claim 55, further comprising the step of cleaning the openings in the at least one nozzle plate by directing a needle-shaped water jet at the openings.

58. The method of claim 55, further comprising the step of cleaning the at least one nozzle plate with ultrasound at the at least one nozzle plate.

59. The method of claim 55, further comprising the step of controlling the amount of treating agent fed to the moving surface as a function of the volume flow of the treating agent.

60. An apparatus for spreading a treating agent onto a moving surface, comprising:

at least one feeding chamber for receiving a treating agent;

means for directing the treating agent from said at least one feeding chamber onto the moving surface, said means including at least one nozzle plate that at least partly closes said at least one feeding chamber, said at least one nozzle plate including openings and having a length that is greater than a width of an area of the moving surface that is to be treated, wherein each of said openings comprise a periphery defined entirely by said at least one nozzle plate, and wherein continuous jets of the treating agent are formed by said openings and directed onto the moving surface when the feeding chamber is at least partially filled with pressurised treating agent; and an actuator operatively connected to said at least one nozzle plate for moving said at least one nozzle plate relative to said at least one feeding chamber so that said at least one nozzle plate is at least partly outside the width of the area of the moving surface that is to be treated.

61. The apparatus according to claim 60, further comprising at least one steam nozzle operatively arranged for blowing steam towards said at least one nozzle plate.

62. The apparatus of claim 60, further comprising means for directing at least one needle-shaped water jet at the openings of said at least one nozzle plate.

* * * * *